United States Patent [19]

Hoskinson et al.

[11] 4,253,366

[45] Mar. 3, 1981

[54] LARGE SCALE INTEGRATED CIRCUIT CHIP FOR AN ELECTRONIC ORGAN

[75] Inventors: William R. Hoskinson, Geneva; Harold O. Schwartz, Elburn, both of Ill.

[73] Assignee: The Wurlitzer Company, DeKalb, Ill.

[21] Appl. No.: 917,312

[22] Filed: Jun. 20, 1978

[51] Int. Cl.[3] ..... G10H 1/38; G10H 1/40; G10H 5/00

[52] U.S. Cl. ..... 84/1.03; 84/1.26; 84/DIG. 12; 84/DIG. 22; 84/DIG. 23

[58] Field of Search ..... 84/1.01, 1.03, 1.24, 84/1.26, DIG. 8, DIG. 11, DIG. 12, DIG. 22, DIG. 23

[56] References Cited

U.S. PATENT DOCUMENTS

| | | | |
|---|---|---|---|
| 3,515,792 | 6/1970 | Deutsch | 84/1.24 |
| 3,639,913 | 2/1972 | Watson | 84/1.01 |
| 3,696,201 | 10/1972 | Arsem et al. | 84/1.01 |
| 3,706,837 | 12/1972 | Arsem et al. | 84/1.03 |
| 3,715,442 | 2/1973 | Freeman | 84/1.03 |
| 3,828,109 | 8/1974 | Morez | 84/1.01 |
| 4,033,221 | 7/1977 | Tomisawa | 84/1.03 |
| 4,046,047 | 9/1977 | Roberts | 84/1.24 |
| 4,055,103 | 10/1977 | Machanian | 84/DIG. 22 |
| 4,116,102 | 9/1978 | Tsunoo | 84/1.01 |
| 4,137,810 | 2/1979 | Wheelwright | 84/1.03 |
| 4,138,916 | 2/1979 | Kitagawa | 84/1.01 |
| 4,138,918 | 2/1979 | Kato | 84/DIG. 22 |
| 4,148,241 | 4/1979 | Morez et al. | 84/1.24 |

*Primary Examiner*—Stanley J. Witkowski

*Attorney, Agent, or Firm*—Trexler, Wolters, Bushnell & Fosse, Ltd.

[57] ABSTRACT

In a modular, expandable organ system comprising a plurality of large scale integrated circuit (LSI) chips an LSI chip is provided which produces chord and bass frequency generation and identification. It automatically coordinates with another chip in rhythm production. It incorporates frequency generators, identifies a chord played, and provides keyers for chord notes.

11 Claims, 2 Drawing Figures

LARGE SCALE INTEGRATED CIRCUIT CHIP FOR AN ELECTRONIC ORGAN

BACKGROUND OF THE INVENTION

Figure 1:
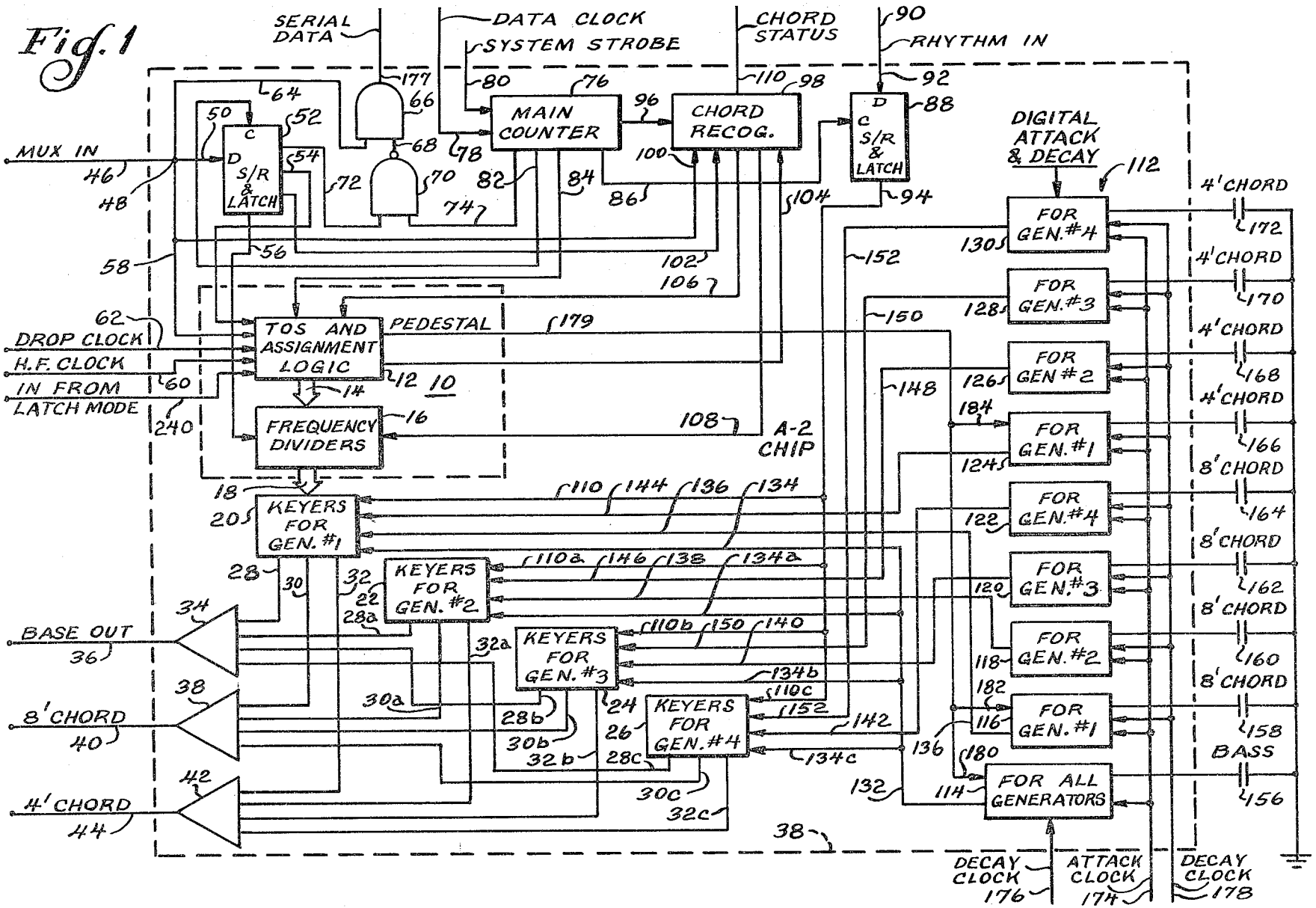

Electronic organs have been known in the patent arts and in the marketplace for many years. Such organs heretofore generally operated on analog principles with the provision of one tone generator for each note of the organ. It has been common practice to use separate oscillators for each generator, or to provide twelve master oscillators for the top octave or one octave above the top octave with divide-by-two circuits for producing the remaining octaves of the organ. More recently it has become rather common practice to provide a single high frequency master oscillator and to divide the frequency thereof by parallel dividing circuits of different divider ratios to provide the top octave of notes, such top octave being applied to strings of divide-by-two circuits to provide the gamut of the organ.

More recently, efforts have been made to produce electronic organs using digitial techniques, including to some degree the elimination or minimization of redundancy in the number of tone generators, and a multiplexing of keyboards. Digital circuits for electronic organs are relatively easily embodied in large scale integrated circuit (LSI) chips, whereas it is relatively difficult to embody analog circuits in such chips.

OBJECTS AND SUMMARY OF THE INVENTION

It is an object of the present invention to provide in an electronic organ an LSI chip including means for identifying and generating the proper frequencies for chords played on the organ and for keying the chord notes out of the chip.

More particularly, it is an object of the present invention to provide a digital integrated circuit chip for use in an electronic organ which receives multiplexed serial information from the organ keyboard and which utilizes such information to generate frequencies corresponding to the chordal notes played on the keyboard, the LSI chip also having means for keying the chord notes generated out of the chip.

Yet another object of the present invention is to provide an LSI chip for use in an electronic organ, which chip includes means for recognizing and generating the frequencies corresponding to chord notes played on the organ and transmitted to the chip by multiplexed information, wherein digital attack and decay means are used in combination with keyers for keying the chord notes out of the chip.

A further object is to be able to play either a chord from a single key or from normally determined separate keys in either a latched or unlatched mode.

In order to achieve the foregoing and other objects and advantages of the present invention, an LSI chip is constructed in accordance with metal oxide silicon (MOS) technology, now standard in the semiconductor industry. The chip is provided with a shift register and latch for receiving serial multiplexed information from the organ keyboard. A main counter is provided on the chip which is operated from a data clock and a system strobe which is common to chips in the organ system where correct timing is essential to demultiplexing the serially multiplexed information.

Top octave synthesizers (TOS) are provided and are similar to those known in the art. The synthesizers are operated by a high frequency clock under the control of a shift register and latch and also the main counter to provide the proper frequencies for chord notes played on the keyboard of the organ. A bass accompaniment is also provided, and keyers are provided for keying the bass and eight foot and four foot chords out of the chip. Digital attack and decay circuits operate in cooperation with keyers. An input shift register and latch accept rhythm information from a source external of the present chip. This shift register and latch operate under control of the main counter and provide information to the keyers for operating the keyers at proper times.

DRAWING DESCRIPTION

Figure 2:
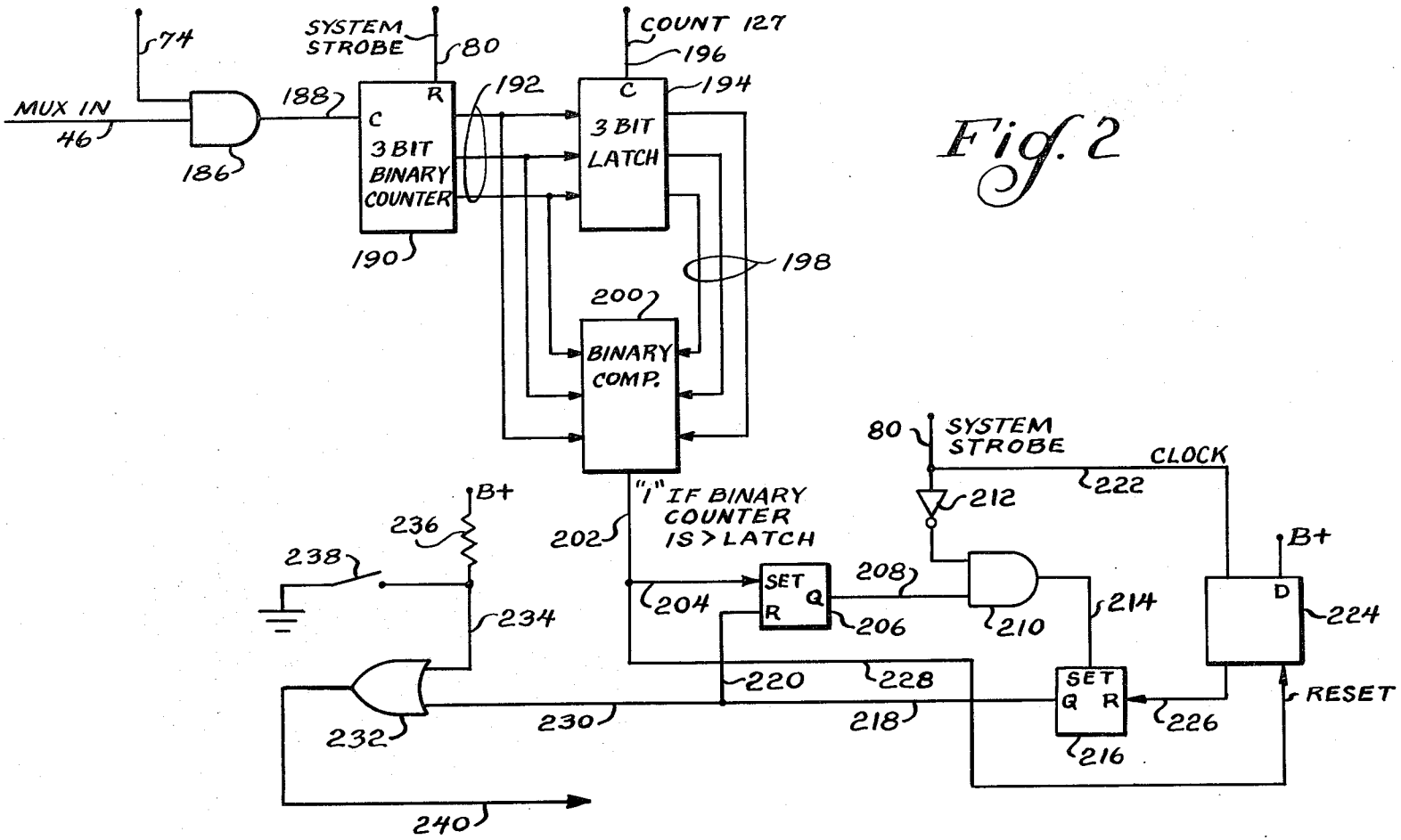

The present invention will best be understood with reference to the figures of the drawings when taken in connection with the accompanying specification. In the drawings:

FIG. 1 comprises an electrical wiring diagram illustrating the principles of the present invention; and FIG. 2 is another electrical wiring diagram illustrating the latched mode of operation for chord playing.

DETAILED DISCLOSURE

The present invention correlates with other copending applications. In particular, a modular expandable organ system is shown in the copending application of Harold O. Schwartz, Dennis E. Kidd and William R. Hoskinson filed June 20, 1978, Ser. No. 917,310 assigned to the same assignee as the present application, namely The Wurlitzer Company of DeKalb, Ill. The subject matter of the present invention comprises the A-2 chip as shown in the aforesaid copending application. Hence, FIG. 1 is labeled as "A-2 Chip".

The chip includes four frequency generating circuits, only the first of which is shown herein at 10. The second, third and fourth are identical and are similarly connected. The frequency generator 10 is the same as that disclosed in the copending patent application of William R. Hoskinson and William V. Machanian filed June 20, 1978 under Ser. No. 917,305 also assigned to The Wurlitzer Company and includes a top octave synthesizer (TOS) 12 which has a plurality of outputs 14 to a frequency divider 16. Outputs from the frequency dividers 18 lead to the keyers 20 for generator #1. Similar keyers for generators #'s 2, 3 and 4 are respectively shown at 22, 24 and 26, even though the frequency generating circuits are not shown herein.

Each of the keyers 20, 22, 24 and 26 includes in essence three keyers, keyer 20 having three outputs 28, 30 and 32. To avoid duplication of description, the like outputs for keyers 22, 24 and 26 are labeled with the same numerals as the outputs of the keyers 20, with the respective addition of suffixes a, b and c. One output of each keyer, those labeled 28, **28*a*, 28*b* and 28*c* has the enveloped frequency to be connected to a combining amplifier 34 providing a bass output 36 from the rectangle 37** representing the physical environs of the chip.

A second output from each of the keyers, specifically the outputs 30, **30*a*, 30*b* and 30*c* carry the enveloped frequencies for an eight foot chord output and its connected to combining amplifier 35 having an output 40** from the chip.

Similarly, the third output from each of the keyers, namely outputs 32, **32*a*, 32*b* and 32*c* carry the enveloped frequencies for a four foot chord output, and all of these outputs are combined at 42 in a combining amplifier having a four foot chord output 44** from the chip.

Each frequency generating circuit such as the circuit 10 illustrated includes information obtained externally of the chip. Serial multiplexed data is supplied to an input 46 leading to an internal junction 48. From this junction connection is made at 50 to the D input of a shift register and latch 52. The latch portion of the shift register and latch 52 provides an output 54 with external switch information leading to each of the top octave synthesizers as 12, and additional information on an output 56 from the latch leads to the frequency dividers 16 to enable the footages of the chord frequencies and to enable the bass frequencies.

Multiplexed information appearing at junction 48 is applied to a conductor 58 also leading to the top octave synthesizers. The non-latched multiplexed information is used by the TOS in coordination with the chord recognizer 98 for note assignment purposes.

Additional information also is supplied from external sources. A high frequency clock input line 60 leads into the top octave synthesizers as does a drop clock input line 62. The drop clock line functions to eliminate or drop a pulse from the high frequency clock (both of these inputs being rectangular waves) in order to detune each oscillator slightly from its nominal frequency. Such detuning is disclosed in full in the copending application of Anthony C. Ippolito and William R. Hoskinson filed June 20, 1978 under Ser. No. 917,296 also assigned to The Wurlitzer Company and now U.S. Pat. No. 4,196,651.

An additional conductor 64 leads from the junction 48 to one input of an AND gate 66. The second input 68 to the AND gate 66 comprises the output of a NAND gate 70. One input of the NAND gate 70 comprises a conductor 72 from the shift register and latch 52, while the other comprises a conductor 74 from a main counter 76.

The main counter 76 has two inputs from outside the chip. One of these inputs 78 carries information from an exterior data clock. The other input 80 carries a system strobe input which is common to other circuits in the organ to insure proper timed relation thereof.

Besides the output 74 the main counter has an output 82 leading to the clock input of the shift register and latch 52. The main counter also has an output 84 leading to the top octave synthesizer and assignment logic 12.

The main counter 76 has another output 86 leading to the clock input of a shift register and latch 88. An external connection 90 conducts a Rhythm In signal to the data input 92 of the shift register and latch 88. The shift register and latch has an output 94 which will be taken up shortly hereinafter.

Another output 96 from the main counter 76 leads to a chord recognizer 98. One input 100 to the chord recognizer 98 is from the line 58 connected to the multiplex in connection 46. A further input connection 102 to the chord recognizer comprises an output of the shift register and latch 52. Another input connection 104 to the chord recognizer is from the top octave synthesizer and assignment logic 12.

The chord recognizer 98 has an output 106 leading to the top octave synthesizer and assignment logic 12. It also has an output 108 leading to the frequency dividers 16. Yet another output 110 extends externally of the chip to provide chord status information. The interaction of the chord recognizer 98 with the top octave synthesizer and assignment logic 12 and with the frequency dividers 16 is set forth in the copending application of William R. Hoskinson and William V. Machanian filed June 20, 1978 under Ser. No. 917,305 also assigned to The Wurlitzer Company.

The output 94 of the shift register and latch 88 is connected through branch conductors 110, **110*a*, 110*b* and 110*c* respectively to the keyers 20, 22, 24 and 26. Additional input to the keyers is provided from digital attack and decay circuits 112** which are disclosed in detail in the copending application of William R. Hoskinson filed June 20, 1978 under Ser. No. 917,308.

The digital attack and decay circuits 112 comprise individual circuits for different generators as labeled. Circuit 114 is all for generators, circuit 116 is for generator #1, circuit 118 is for generator #2, circuit 120 is for generator #3, and circuit 122 is for generator #4, the last four being for the eight foot chord. The circuit 124 is for generator #1, the circuit 126 is for generator #2, the circuit 128 is for generator #3, while circuit 130 is for generator #4, the last four circuits being for the four foot chord.

As indicated, the attack and decay circuit 114 is for all generators, and has an output 132 branching at 134, **134*a*, 134*b* and 134*c* to all of the keyers 20, 22, 24 and 26**.

Circuit 116 has an output at 136 leading to keyer 20 for generator #1. Similarly, circuit 118 has an output 138 leading to keyer #22, while circuit 120 has an output 140 leading to keyer 24, and circuit 122 has an output 142 leading to keyer 26. The foregoing keyers are for the bass and for the eight foot chord. Turning to the four foot chord, circuit 124 has an output 144 leading to keyer 20, circuit 126 has an output 148 leading to keyer 22, circuit 128 has an output 150 leading to keyer #3, and circuit 130 has an output 152 leading to keyer 26.

As set forth in the aforesaid Hoskinson application Ser. No. 917,308 each digital attack and decay circuit is provided with an envelope determining capacitor external to the chip. Thus, in the present case there is a bass envelope capacitor external to the chip and connected to the circuit 114. There are four eight foot chord envelope capacitors, 158, 160, 162 and 164 external of the chip and respectively connected to the circuits 116, 118, 120 and 122. Similarly, there are four external four foot chord capacitors 166, 168, 170 and 172, respectively connected to the circuits 124, 126, 128 and 130. An attack clock input 174 leads to all of the digital attack and decay circuits 112 and comprises a digital wave of variable duty cycle to control the attack of the generators, in accordance with the aforesaid Hoskinson copending application. A decay clock input line 176 is connected to the attack and decay circuit 114 for all of the generators which controls all of the keyers as to the bass output 36. Another decay clock input 178 is connected to the remaining digital attack and decay circuits, that is all but the circuit 114. This determines the decay envelope for both the eight foot and four foot chord frequencies of the keyers 20, 22, 24 and 26, thus determining the decay of the eight foot chord output 40 and of the four foot chord output 44. As the capacitors have just been described, it is implicit that one side or plate of each thereof is connected to the respective digital attack and decay circuit. The opposite side or plate of each capacitor is connected to a ground line 175 exterior of the chip. In connection with reference to ground, it should be noted that what is nominally ground in an LSI chip is not necessarily a ground potential. It is a fixed reference point which may coincide with ground, or which may be a specific positive or negative DC potential.

The various components and interconnections of the present invention have now been set forth except for the serial data output 177 of the AND gate 66 extending exteriorly of the chip.

It is not desired that multiplex informaton as to the playing of chords should be passed on to other chips in the system. This is prevented by stripping information from the multiplex information before it is passed on from the A-2 chip disclosed herein. This stripping is effected in the AND gate 66 in combination with operation of the NAND gate 70 by the main counter. The AND gate 66 is disabled for the first several counts to prevent the multiplex information from being passed out on the serial data line 177. The NAND gate 70 receives information from the shift register and latch 52 to the effect that the A-2 chip is disabled which will cause the NAND gate 70 to have a "1" output, whereby the AND gate 66 will pass all serial data information.

Also not previously mentioned is the pedestal output 179 of the top octave synthesizer 12. This pedestal output leads at 180 to attack and decay circuit 114, at 182 to attack and decay circuit 116, and at 184 to attack and decay circuit 124. Thus, whenever any note is assigned to the top octave synthesizer #1 there will be an enabling potential applied for the bass attack and decay circuit, for generator #1 eight foot chord circuit and for generator #1 four foot chord circuit. Similarly, each of the other three generators have a pedestal output which is applied to the corresponding attack and decay circuit.

All of the digital attack and decay circuits 112 are normally held in the decay mode until a key is depressed. The assigned top octave synthesizer puts out its pedestal potential as at 179 which immediately directs the respective attack and decay circuits into attack mode of which continues for the time the key is held depressed (active) or for a predetermined number of counts of the main counter, at which time the decay mode is forced active.

The bass being carried is the correct root of a chord being played, or if there is not a recognizable chord, then the bass frequency will be the sixteen foot pitch of the lowest activated chord note. In accordance with the aforesaid Hoskinson et al copending patent application, the chord recognizer 98 will identify which chord element each generator is playing, and recognize what chord is being played by the three chord elements, root, third and fifth. If the chord recognizer 98 does not identify a generator as being either a root, third or fifth chord element, and a triad chord was requested by the user, this generator will be assigned to the seventh element of the chord; to be used for bass accompaniment only. Each generator after this assignment will have a bass frequency available as in the aforesaid Hoskinson application. For example, the generator with the root frequency will have two bass frequencies, the bass root and a bass fourth. The generator with assignment of the third partial of the chord will have the third bass frequency and the sixth bass frequency. The generator with the assignment of the fifth partial of the chord will have a fifth bass frequency available. These frequencies are available from the respective dividers. If a four note chord is requested and the chord recognizer does not identify a generator as not being a root, third or fifth chord element, this generator will play the note requested at a four foot pitch, an eight foot pitch and a bass pitch.

By way of specific example, assume that a C chord is requested and that generator 1 has the root frequency C assigned to it. The chord recognizer will recognize the chord and will send out information on the line 108 to the frequency dividers to identify a proper bass root, in this illustrative example, a C. It will also provide the fourth chord partial identification of this root (namely an F, by way of the added 3/2 division and gating circuit). It will also provide a C frequency for the eight foot chord and a C frequency for the four foot chord.

If the rhythm is on as in the copending application of Harold O. Schwartz and Dennis E. Kidd filed June 20, 1978 under Ser. No. 917,311 also assigned to The Wurlitzer Company and now U.S. Pat. No. 4,218,949, there will be an input signal on the rhythm in line 90. A percussive mode is forced, the attack time on the keyers from the digital attack and decay circuit being on for the order of four and one-half to five scan frames with the pedestal output 179 up for this period. The multiplexed input information at 46 carries stop tablet information as well as key switch information and provided information as to whether the rhythm is turned on or off, in particular as to whether rhythm is on the chords and bass. This information to the shift register and latch 52 acts with the rhythm in information at 90 to force the percussive mode through the pedestal output 179 from the top octave synthesizer 12. The information in at 90 to the shift register and latch 88 also indicates whether a chord or bass should be keyed. The combination of this information and the multiplex in information operates the keyers 20, 22, 24 and 26.

On the other hand, if there is no information on the rhythm input connection 90 to the shift register 88, the frequencies will simply be gated out. The various audio frequency outputs will not be pulsed in time with the rhythm, but will just play constantly.

If a chord is recognized by the chord recognizer 98, the serial output 110 can be decoded to tell what the root of the chord is. Serial bits out on the output 110 can be used for many purposes, for example, for constructing an arpeggio from the root note of the chord.

For playing in the latched mode, it is desired that a chord which is played should continue to play (even though the chord keys be released) until a subsequent chord is played. Circuitry for effecting this desired end is shown in FIG. 2.

The conductor 74 from the main counter 76 (FIG. 1) is connected to one input of an AND gate 186, the other input being the multiplex data in 46. The output 188 of the AND gate is connected to the clock input of a 3-bit binary counter 190. The reset input is connected to the system strobe 80 so that the counter 190 is reset on count zero of a 128 count cycle. The three binary outputs 192 of the counter 190 are applied to the inputs of a 3-bit latch 194. The latch is clocked by an input on the clock line 196 at count 127 of the aforesaid 128 count cycle. The three outputs 198 of the latch are connected to a binary comparator 200. The output of the 3-bit binary counter is also connected to the binary comparator 200. The comparator 200 is equivalent to 74C85.

The output 202 of the comparator is applied at 204 to the set input of a set and reset latch 206. The Q output of this latch is connected at 208 to one input of a two input AND gate 210. The second input is from system strobe 80 through an inverter 212.

The output 214 of the AND gate 210 leads to the set input of another set and reset latch 216. The Q output of latch 216 is a conductor 218 having a branch conductor 220 leading to the reset input of the latch 206.

The system strobe 80 is connected at 222 to the clock input of a five bit shift register 224. The data input is connected to B+, while the output 226 leads to the reset input of latch 216.

The output 202 of the binary comparator 200 continues at 228 to the reset input of shift register 224. The Q output 218 of latch 216 continues at 230 to one input of a two input OR gate 232. The second input to this gate is a conductor 234 leading through a resistor 236 to B+, and to the fixed contact of a single pole-single throw switch 238, the movable contact of which is connected to ground. It will be understood that the switch 238 is illustrative only, and in practice would comprise a suitable gate on the LSI chip controlled by a remote multiplexed switch on the organ keyboard.

The output 240 of the OR gate 232 leads to the respective top octave synthesizer and assignment logic 12 in FIG. 1.

The basic principle of operation of the circuit of FIG. 2 is that for each multiplex scan or frame, the number of chord notes is counted (assuming the latched mode of operation). If the same or a lesser number of key switches is found closed in a scan, the latched chord continues to play without change. However, if a greater number of closed key switches is counted, the new chord is latched. In each case, the latch is updated to the current number of key switches detected as active.

The gate 186 allows only multiplexed information in the chord playing area to pass through the 3-bit counter. The 3-bit binary counter is clocked thereby and the binary outputs 192 indicate how many key switches are active. This information is transferred to the latch at count 127. The binary comparator indicates on its output whenever the counter has a number higher than the number in the latch. Thus, if on a given scan, the number of active keys is zero, the chord keys having been released, and on the next scan three or four keys are active, there will be an output of the comparator at 202. This results in a "1" out of the Q output 208 of latch 206. The "1" out of the comparator 200 on conductors 202 and 228 resets the five bit shift register 224. System strobe at 80 with a "1" on one of the inputs of AND gate 210 and a "1" on conductor 208 sets the latch 216 and its Q output 218 is then a "1". If the switch 238 is assumed to be closed, the resulting "0" conductor 234 coacts with the "1" on conductor 218,230 to produce a "1" on the OR output conductor 240, thus providing a "1" into the TOS and assignment logic 12 to update it. At the same time, the "1" on conductor 218,220 resets the latch 206.

Five strobe pulses on conductors 80, 222 clock the "1" on the data input (from the B+ connection) through the shift register 224 to reset the latch 216. "0" out of this latch results in two "0's" being applied to the OR gate 232, which therefore has a "0" out to hold the chord being played.

With the switch 238 open there is always a "1" from the B+ connection as an input to the OR gate 232, resulting in a "1" out, and a continuous updating of the top octave synthesizers and assignment logic.

The circuits shown may be embodied either using separate integrated circuits connected in the manner shown or a single integrated circuit incorporating all of the elements shown. Such an integrated circuit may be fabricated using process techniques well known in the semiconductor industry, desirably in metal oxide silicon (MOS) form. Since such techniques do not form a part of this invention, they will not be described in further detail.

It will be seen from the foregoing that the LSI chip disclosed herein provides chord and bass frequency generation and identification. It automatically coordinates these with rhythm being played by the organ. It also operates with the digital attack and decay circuits in combination with the keyers to provide enveloped bass and chords. The specific example of the invention as herein shown and described is for illustrative purposes. Those skilled in the art will perhaps find variations thereof which are to be considered a part of the present invention insofar as they fall within the spirit and scope of the appended claims.

The invention is claimed as follows:

1. For use in an electronic organ or the like, a large scale integrated circuit chip comprising a plurality of assignable frequency generators, each of which is assignable for generating electrical oscillations corresponding to any of a plurality of musical notes playable by the organ or the like, input means for receiving multiplexed information from the keyboard of an electronic organ or the like as to notes played thereon, said input means comprising latching means having input and output connections, a comparator having an output and further having two input means respectively connected to the latching means input and output connections, said comparator having a signal on said output when said latching means input connection has a greater number of multiplex pulses than appear on said latching means output connection, means interconnecting said input means including said comparator output and said frequency generators to cause said generators to produce oscillations corresponding to the notes carried in the multiplexed information, frequency dividing means connected to receive said oscillations from said frequency generators and to produce therefrom further oscillations at octavely related frequencies for playing said notes at different organ footages, keying means interconnected with said frequency dividers for selectively conducting the outputs thereof, means for receiving rhythm information, means interconnecting said rhythm receiving means and said keyers for selectively rendering said keyers effective in accordance with rhythm information received, and attack and decay circuits interconnected with said keyers for providing attack and decay characteristics thereto.

2. An integrated circuit chip as set forth in claim 1 wherein said attack and decay circuits comprise digital circuits, and further including external connecting means on said chip interconnected with said attack and decay circuits adapted to have external capacitor means connected thereto for coaction with said attack and decay circuits.

3. An integrated circuit chip as set forth in claim 1 and further including means for individually detuning each frequency generator from its nominal frequency to avoid intra-octave locking of oscillations.

4. An integrated circuit chip as set forth in claim 2 and further including means for individually detuning each frequency generator from its nominal frequency to avoid intra-octave locking of oscillations.

5. An integrated circuit chip as set forth in claim 1 and further including means for counting the number of active key switches on each scan of said key switches, said counting means being connected to the input connections of said latching means, and means for altering said frequency generators when the number of active key switches counted is greater than the number of active key switches counted in the preceding scan.

6. For use in an electronic organ or the like, a large scale integrated circuit chip comprising a plurality of frequency generators for generating electrical oscillations corresponding to musical notes, input means for receiving multiplexed information from the keyboard of an electronic organ or the like as to notes played thereon, said input means comprising latching means having input and output connections, a comparator having an output and further having two input means respectively connected to the latching means input and output connections, said comparator having a signal on said output when said latching means input connection has a greater number of multiplex pulses than appear on said latching means output connection, means interconnecting said input means including said comparator output and said frequency generators to cause said generators to produce oscillations corresponding to the notes carried in the multiplexed information, frequency dividing means connected to said frequency generators to produce oscillations at octavely related frequencies for playing said notes at different organ footages, keying means interconnected with said frequency dividers for selectively conducting the outputs thereof, means for receiving rhythm information, means interconnecting said rhythm receiving means and said keyers for rendering said keyers effective in accordance with rhythm information received, and attack and decay circuits interconnected with said keyers for providing attack and decay characteristics thereto, means interconnected with the multiplexed information receiving input means, and means interconnected with said last named means for selectively altering data from the multiplexed information and for subsequently conducting the multiplexed information from said chip.

7. An integrated circuit chip as set forth in claim 6 and further including means for individually detuning each frequency generator from its nominal frequency to avoid intra-octave locking of oscillations.

8. For use in an electronic organ or the like, a large scale integrated circuit chip comprising a plurality of frequency generators for generating electrical oscillations corresponding to musical notes, input means for receiving multiplexed information from the keyboard of an electronic organ or the like as to notes played thereon, means interconnecting said input means and said frequency generators to cause said generators to produce oscillations corresponding to the notes carried in the multiplexed information, frequency dividing means connected to said frequency generators to produce oscillations at octavely related frequencies for playing said notes at different organ footages, keying means interconnected with said frequency dividers for selectively conducting the outputs thereof, means for receiving rhythm information, means interconnecting said rhythm receiving means and said keyers for rendering said keyers effective in accordance with rhythm information received, and attack and decay circuits interconnected with said keyers for providing attack and decay characteristics thereto, means interconnected with the multiplexed information receiving input means, and means interconnected with said last named means for selectively altering data from the multiplexed information and for subsequently conducting the multiplexed information from said chip, the means for selectively altering information from the multiplexed information comprises a gate, and means for biasing said gate off for a predetermined number of counts synchronized with the multiplexed information.

9. For use in an electronic organ or the like, a large scale integrated circuit chip comprising a plurality of frequency generators for generating electrical oscillations corresponding to musical notes, input means for receiving multiplexed information from the keyboard of an electronic organ or the like as to notes played thereon, said input means comprising latching means having input and output connections, a comparator having an output and further having two input means respectively connected to the latching means input and output connections, said comparator having a signal on said output when said latching means input connection has a greater number of multiplex pulses than appear on said latching means output connection, means interconnecting said input means including said comparator output and said frequency generators to cause said generators to produce oscillations corresponding to the notes carried in the multiplexed information, frequency dividing means connected to said frequency generators to produce oscillations at octavely related frequencies for playing said notes at different organ footages, keying means interconnected with said frequency dividers for selectively conducting the outputs thereof, means for receiving rhythm information, means interconnecting said rhythm receiving means and said keyers for rendering said keyers effective in accordance with rhythm information received, and attack and decay circuits interconnected with said keyers for providing attack and decay characteristics thereto, wherein said attack and decay circuits comprise digital circuits, and further including external connecting means on said chip interconnected with said attack and decay circuits adapted to have external capacitor means connected thereto for coaction with said attack and decay circuits, means interconnected with the multiplexed information receiving input means, and means interconnected with said last named means for selectively altering data from the multiplexed information and for subsequently conducting the multiplexed information from said chip.

10. For use in an electronic organ or the like, a large scale integrated circuit chip comprising a plurality of frequency generators for generating electrical oscillations corresponding to musical notes, input means for receiving multiplexed information from the keyboard of an electronic organ including information as to which key switches are active, means interconnecting said input means and said frequency generators to cause said generators to produce oscillations corresponding to the active key switches carried in the multiplexed information, second means interconnecting said input means and said frequency generators for latching said frequency generators to cause continued production of oscillations corresponding to active key switches even if said key switches become inactive, said second interconnecting means comprising means for counting the number of active key switches in each scan of said key switches and for comparing the number of active key switches with the number of active key switches in a previous scan, and means for altering said frequency generators when the number of active key switches in a scan is found to be greater than in a preceding scan.

11. An integrated circuit chip as set forth in claim 10 wherein the counting means comprises a counter having a plurality of parallel outputs and a latch comprising a like plurality of parallel inputs connected to said outputs and further having a like plurality of parallel outputs, the comparing means comprising a comparator having two sets of parallel inputs respectively connected to said counter outputs and said latch outputs, and itself producing an output when the number from the counter is higher than the number from the latch.

* * * * *